US006152501A

United States Patent [19]

Magi et al.

[11] Patent Number: 6,152,501

[45] Date of Patent: Nov. 28, 2000

[54] GLOVE BOX DOOR HANDLE AND LATCH ASSEMBLY

[75] Inventors: Hugo Magi, Bloomfield Hills; Yuriy Tsalenko, West Bloomfield, both of Mich.

[73] Assignee: NYX, Inc., Livonia, Mich.

[21] Appl. No.: 09/318,340

[22] Filed: May 25, 1999

[51] Int. Cl.[7] ..... E05B 3/00

[52] U.S. Cl. ..... 292/336.3; 292/169; 292/DIG. 31

[58] Field of Search ..... 292/165, 169, 292/347–349, 336.3, DIG. 31, DIG. 53, DIG. 63; 16/112

[56] References Cited

U.S. PATENT DOCUMENTS

| | | | |
|---|---|---|---|
| 3,858,921 | 1/1975 | Kuki . | |
| 4,343,501 | 8/1982 | Meeks . | |
| 4,588,219 | 5/1986 | Kobayashi | 292/336.3 |
| 4,589,162 | 5/1986 | Manz | 16/115 |
| 4,653,143 | 3/1987 | Ketelhut et al. . | |
| 4,681,357 | 7/1987 | Uemura et al. . | |
| 4,747,632 | 5/1988 | Joy . | |
| 4,834,433 | 5/1989 | Keller . | |
| 4,872,366 | 10/1989 | Appleby et al. . | |
| 4,907,833 | 3/1990 | Ogasawara et al. . | |
| 4,914,779 | 4/1990 | Nakai et al. . | |
| 5,129,694 | 7/1992 | Tanimoto | 292/347 |
| 5,292,159 | 3/1994 | Sandhu | 292/173 |
| 5,461,755 | 10/1995 | Hardigg | 16/112 |
| 5,484,178 | 1/1996 | Sandhu | 292/173 |
| 5,560,659 | 10/1996 | Dault . | |
| 5,630,630 | 5/1997 | Price | 292/128 |
| 5,651,163 | 7/1997 | Tamaki . | |
| 5,743,575 | 4/1998 | McFarland . | |
| 5,782,510 | 7/1998 | Gass | 292/165 |

FOREIGN PATENT DOCUMENTS

| | | |
|---|---|---|
| 5-321525 | 5/1993 | Japan . |

*Primary Examiner*—Gary Estremsky
*Attorney, Agent, or Firm*—Rader, Fishman & Grauer PLLC

[57] ABSTRACT

A novel glove-box door handle and latch mechanism is disclosed, having a housing member, a handle member, and an actuator member. The housing member is mounted inside of the glove box door, and the handle member includes an axle member which is pivotally mounted to the housing member. The actuator member is slidably disposed in the a channel inside of the housing member, and the handle member engages the actuator member to slide it between its open and closed positions. The handle member includes a pull member and arcuate extension arms connecting the pull member to the axle member to provide greater flexibility to the styling of the pull member. The arcuate extension arms include reinforcing ridges to minimize the necessary material while maintaining their structural rigidity.

21 Claims, 3 Drawing Sheets

GLOVE BOX DOOR HANDLE AND LATCH ASSEMBLY

FIELD OF THE INVENTION

The present invention relates to an improved vehicle glove box door latch mechanism that facilitates a wide range of flexibility in the aesthetic styling of the handle and is economical to manufacture while maintaining its structural integrity.

BACKGROUND

Most previous glove box door handles and latch mechanisms comprise a complex design with a large number of latching components, which result in undesirable design complexity and high manufacturing costs. The large number of components increase the risk of part failure.

Furthermore, most glove box door handles, when pulled by a human operator, facilitate the opening and closing of the latch mechanism by rotating around a fixed pivot point. One of the most economical methods of achieving this functionality is to directly and integrally connect the door handle to a pivotal axle, which freely rotates relative to the rest of the glove box latch mechanism. However, because the rotating axle is necessarily straight, the upper edge of the glove box handle must also be straight since they are directly and integrally connected. If the upper edge of the handle were not straight, movement of the handle would interfere with the trim face plate that normally surrounds the outer edges of the latching assembly to make its integration with the glove box door aesthetically pleasing. Thus, the prior art design limits the aesthetic styling of the glove box door.

Accordingly, it is desirable to provide a vehicle glove box door and latching mechanism with a minimal number of parts, which is economical to produce, and which permits a wide range of aesthetic design flexibility while maintaining structural integrity.

SUMMARY OF THE INVENTION

The present invention is directed toward a vehicle glove box handle and latch assembly. The present invention overcomes the disadvantages known in the prior art by providing a latching mechanism that comprises only three plastic molded parts and a spring. Thus, the number of parts is substantially reduced. Moreover, the mechanism is economically manufactured.

The present invention includes a housing member, an actuator member, and a handle member. The housing member fits inside of and is mounted to the glove box door. The housing member has a vertical channel, which permits the actuator member to slide within it between an open position and a closed position. The actuator member operates to latch the glove box door into place and is normally biased toward the upward or "closed" position by the spring. The handle member includes a pull member for a person to grip, one or more integral extension arms, and an axle member. The integral extension arms connect the handle member to the axle member, with the axle member being pivotally mounted to the housing member. The extension arms include molded ridges that permit the extension arms to be made with less material while maintaining their structural strength. The handle member engages the actuator member so that when the handle member is pulled by an operator, the actuator member slides against the bias of the spring from the actuator member's upward "closed" position to its downward "open" position, permitting the glove box door to open.

The integral extension arms in the present invention permit a wide range of flexibility in designing and styling handle shapes, which permits the same basic latch mechanism to be used in different vehicle models with different glove box handles without having to alter the basic latch mechanism. Without the extension arms, the handle's pull member would be integrally connected with the axle member and, when pulled by a human operator, would rotate immediately about the axle member's longitudinal axis. As discussed above, such a design requires the upper edge of the handle member to maintain a straight edge so that it does not interfere with the trim face plate. In contrast, in accordance with the present invention, the use of the extension arms permits the pull member, when pulled by a human operator, to rotate upward and outward from the housing member as it rotates about the axle member's longitudinal axis. The extension arms permit the handle's pull member to rotate about the axle member at a greater radius than if the pull member was connected directly to the axle member without the use of extension arms. Thus, the pull member can be styled in a variety of shapes without changing the design of the latch mechanism itself. Moreover, because the extension arms are integral with the handle's pull member and its axle member, the number of distinct parts are kept to a minimum, maintaining the mechanism's simplicity.

DETAILED DESCRIPTION OF THE PREFERRED EMBODIMENT

Figure 1:
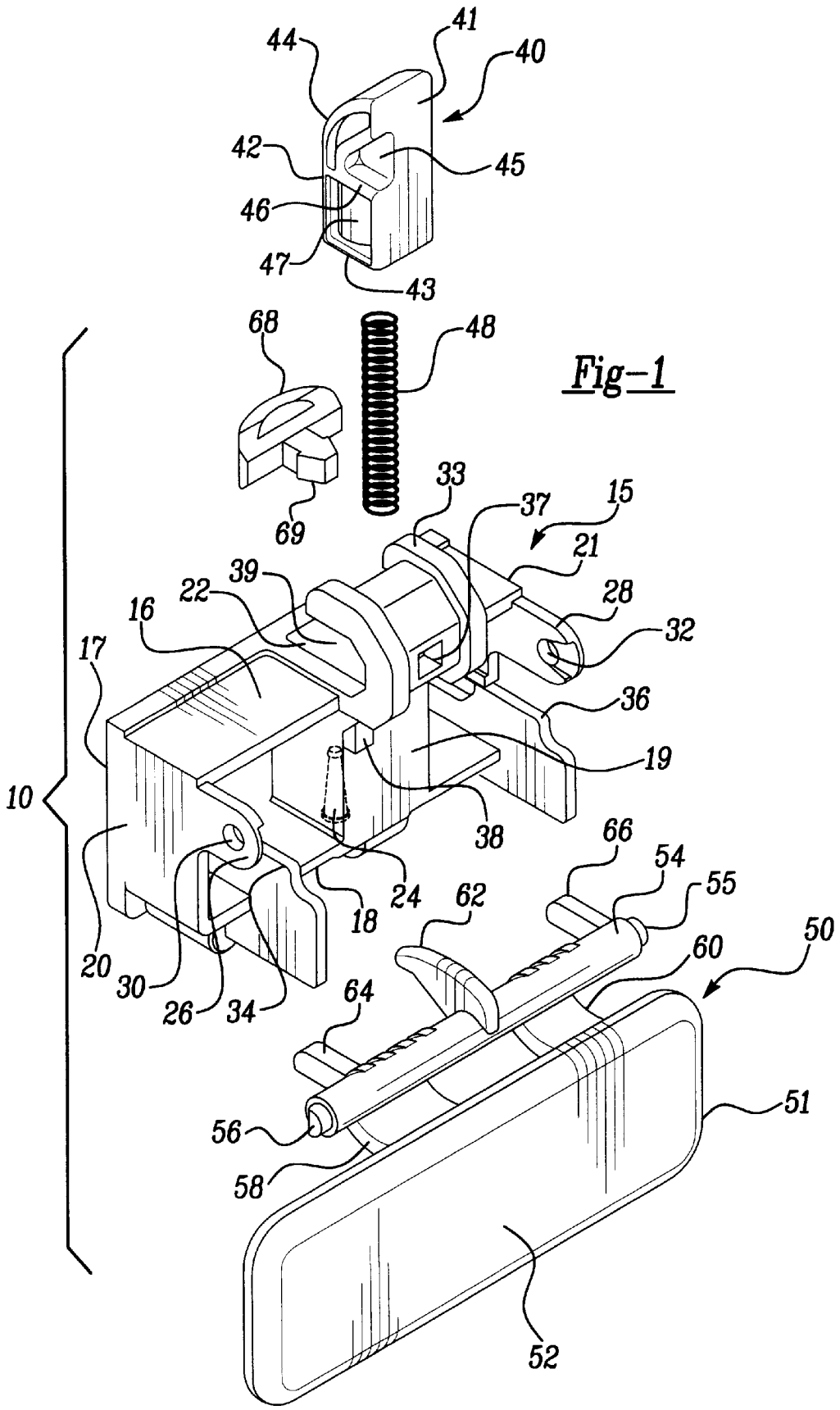
FIG. 1 shows a perspective assembly view of a glove box door and latch mechanism according to the present invention.

FIG. 1 shows a perspective view of a glove box door latch mechanism 10 in accordance with the present invention. Mechanism 10 includes a housing member 15, an actuator member 40, a pivotal handle member 50, a spring 48, and a damping bumper 58.

Housing member 15 is generally a rectangular solid shaped structure having a top face 16, a back face 17, a bottom face 18, a front face 19, and opposing end faces 20 and 21. Housing member 15 includes a receptacle channel 22 extending through the center of housing member 15 from the top face 16 and terminating before reaching the bottom face 18. Thus, receptacle channel 22 has a closed end 21 adjacent the bottom face 18, and an opposing open end 23, which is nearest the top face 16. Housing member 20 further includes a stump member 24 mounted at the base of the closed end 21 of receptacle channel 22 and extending upward through the center of channel 22 toward the open end 23 of the receptacle channel 22. Stump member 24 receives an end of spring 48 as discussed in further detail below.

Housing member 15 further includes opposing mounting flanges 26, 28, which are in the same plane with the opposing end faces 20, 21. Mounting flanges 26, 28 extend outward from the front face 19 near the corner where the top face 16 meets the opposing end faces 20, 21. Mounting flanges 26, 28 include corresponding mounting apertures 30, 32 located near the ends of mounting flanges 26, 28 furthest away from housing member 15.

Housing member 15 includes opposing abutment shoulders 34, 36, which are generally parallel to end faces 20, 21 and which extend outward from the front face 19 near where the bottom face 18 meets the opposing end faces 20, 21. Housing member 15 further includes aperture 38, which is substantially perpendicular to the receptacle channel 22, and which extends between the front face 19 of housing member 15 and the receptacle channel 22. Finally, housing member 15 includes generally arcuate flange 33, which extends upward and backward from the front-most edge of the top face 16 toward the edge where the top face 16 and the back face 17 meet. A portion of flange 33 is generally parallel to top face 16 and outward of the generally rectangular solid portion of housing member 15. Thus, arcuate flange 33 and top face 16 define a crevice 39 therebetween which opens toward the back face 17 of housing member 15.

Figure 2:
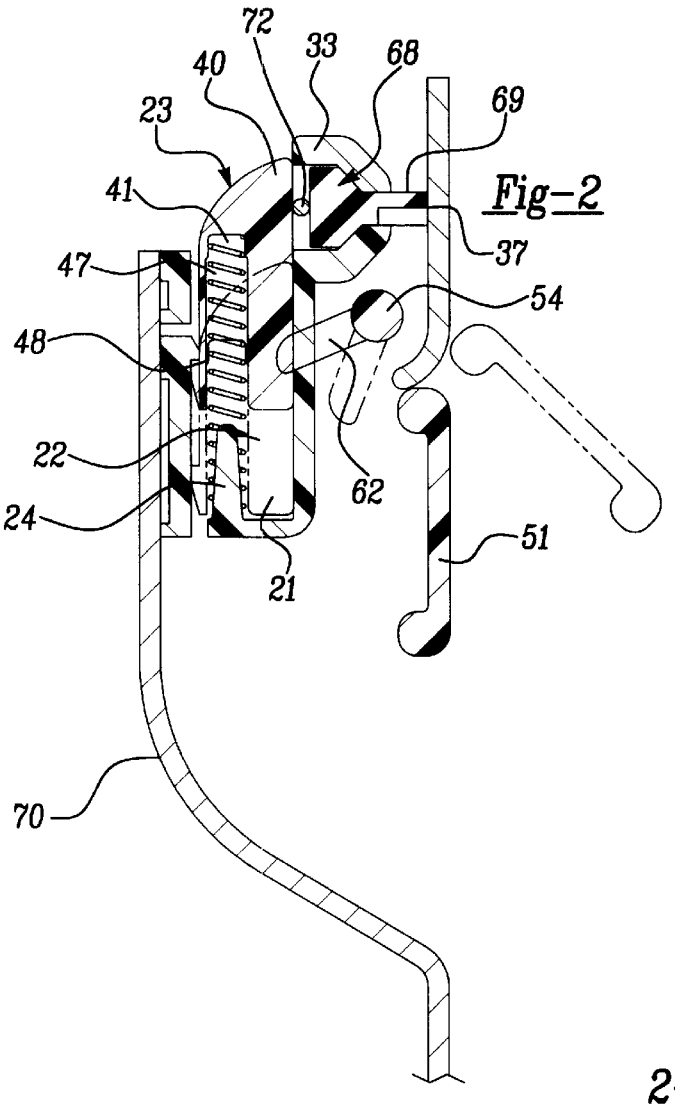
FIG. 2 shows a cross-sectional view taken along line 2—2 in FIG. 3.

As best shown in FIG. 2, crevice 39 is adapted to house damping bumper 68, which has a tab 69 extending outward from damping bumper 68. Hole 37 extends through flange 33 and is adapted to receive and engage with tab 69 to mount damping bumper 68 in crevice 39. Crevice 39 is designed to receive an external latching bar 72, which is fixedly attached to the glove box to lock the glove box door 5 in its closed position.

Figure 5:
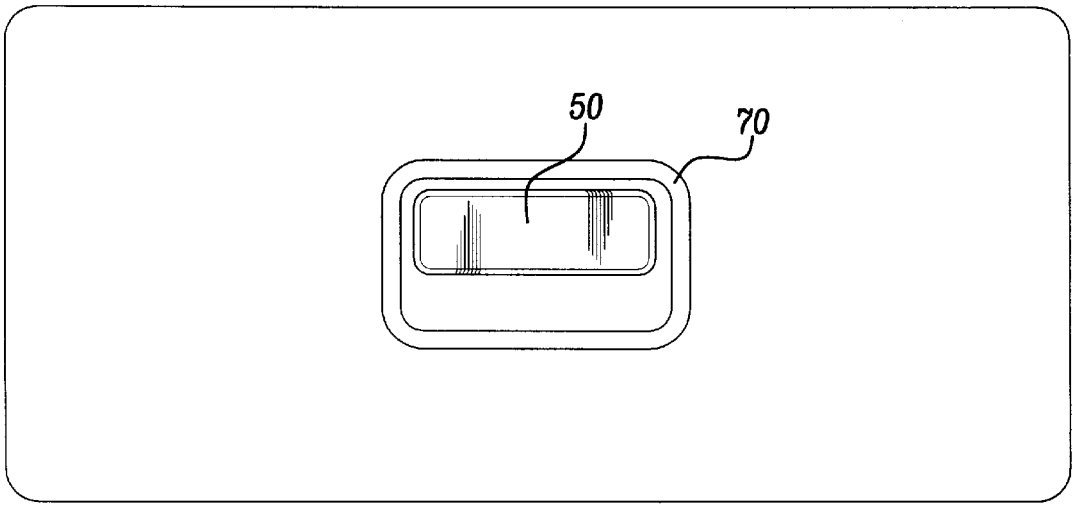
FIG. 5 is a front view of a glove box handle and latch mechanism according to the present invention shown installed in a glove box door.

Housing member 15 is designed to fit inside of and be mounted to a glove box door 5, as shown in FIG. 5, such that the front face 16 points toward the exterior side of the glove box door 5, the back face 17 points toward the interior side of the glove box door 5, the top face 18 points toward the upper portion of the glove box door 5, and the bottom face 18 points toward the bottom portion of the glove box door 5.

As best shown in FIG. 1, actuator member 40 has a generally rectangular shape with a front side 41, a back side 42, and a bottom side 43. Actuator member 40 further includes an upper curved cam surface 44 generally opposing the bottom side 43 and extending between the front side 41 and the back side 42. When viewed in cross-section, as shown in FIG. 2, cam surface 44 has a convex shape, curving upward from the back side 42 to the front side 41. Actuator member 40 also includes a closed channel 47 extending longitudinally from the bottom side 43 of actuator member 40, where the channel 47 is open, upward into the actuator member 40. Front side 41 includes a recess 45 extending toward back side 42 with a bottom surface 46 generally parallel to bottom side 43.

When mechanism 10 is assembled, actuator member 40 is slidably displaced within receptacle channel 22 with its front side 41 directed toward the front face 19 of the housing member 15. Actuator member 40 selectively slides between a vertical upward "closed" position and a vertical downward "open" position. When actuator member 40 is in its "closed" position, as shown in FIG. 2, the front side 41 of actuator member 40 blocks the opening to crevice 39. When actuator member 40 is in its "open" position, the opening to crevice 39 is free of obstruction.

Actuator member 40 is biased toward its closed position by coil spring 48. Coil spring 48 is positioned within receptacle channel 22 such that one end of coil spring 48 abuts the closed end 21 of receptacle channel 22, and the other end of coil spring 48 is disposed within internal channel 41 of actuator member 40 to bias actuator member 40 toward its closed position. Coil spring 48 engages and is maintained in alignment by stump member 24.

Figure 3:
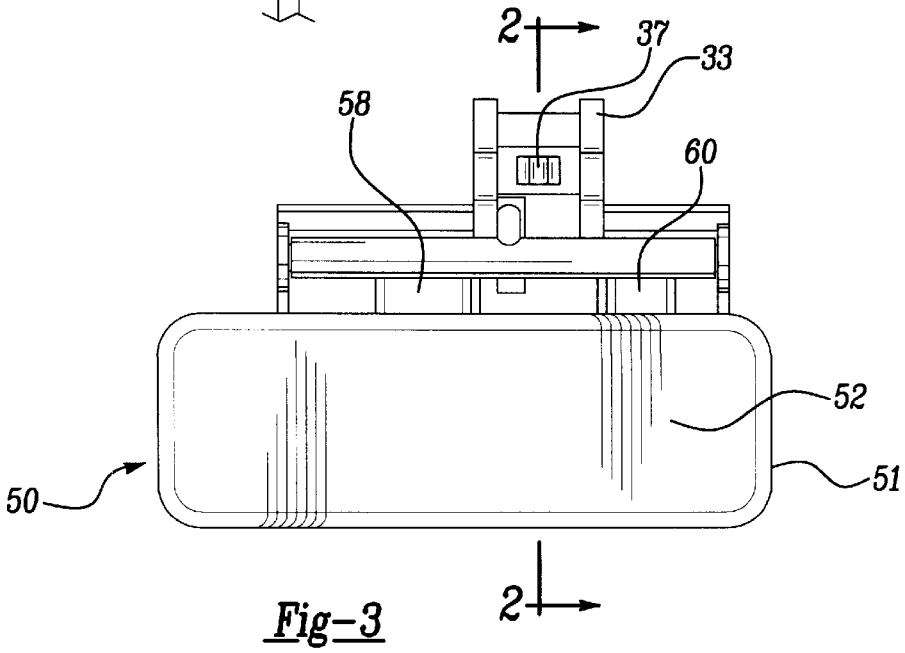
FIG. 3 shows a front view of a glove box door and latch mechanism according to the present invention.
Figure 4:
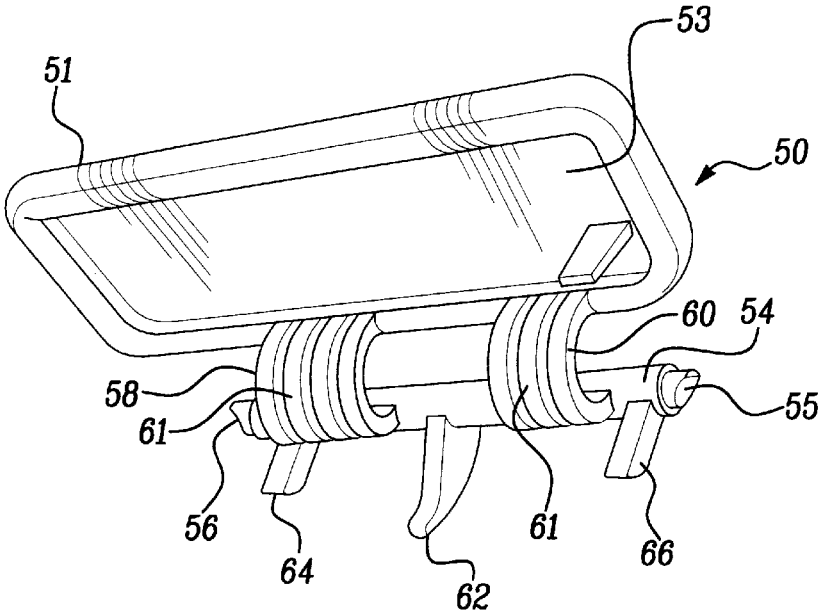
FIG. 4 shows a reverse angle view of the handle member of the present invention.

As best shown in FIGS. 1, 3, and 4, pivotal handle member 50 includes a generally planar pull member 51 which has a front side 52 and an opposing back side 53. The front side 52 is designed to face outward from the glove box door and be exposed to the interior of the vehicle. Integral arcuate extension arms 58, 60 are defined between pivotal handle member 50 and an axle member 54. Preferably, extension arms 58, 60 are integral with axle member 54 and pull member 51 and extend outward and upward from the back side 53 of pull member 51 and connect it to axle member 54.

Preferably, axle member 54 is mounted generally parallel to pull member 51. Axle member 54 includes tabs 55, 56 at its ends. Tabs 55, 56 are adapted to engage and fit inside of mounting apertures 30, 32 of housing member 15 to pivotally attach handle member 50 between mounting flanges 26, 28.

Handle member 50 further includes a lever arm 62, which extends outward from and perpendicular to axle member 54 and away from pull member 51. Lever arm 62 is adapted to extend through aperture 38 of housing member 15 and into recess 45 of actuator 40. Handle member 50 further includes elongated stop arms 64, 66 extending outward from and perpendicular to axle member 54 and away from pull member 51. Stop arms 64, 66 align with shoulders 34, 36 of housing member 15 when handle member 50 is assembled with housing member 15 by inserting tabs 55, 56 in mounting apertures 30, 32.

As shown in FIG. 4, extension arms 58, 60 incorporate structural reinforcement ridges 61 along one of their sides for decreasing the amount of material used to form extension arms 58, 60, while at the same time maintaining their structural rigidity and strength. Accordingly, ridges 61 assist in making the latch mechanism 10 economical to manufacture.

As shown in FIG. 5, trim face plate 70 is attached flush to the glove box door surrounding the front 52 of pull member 51. Trim face plate 70 is designed to aesthetically integrate the handle and latch assembly 10 into the glove box door. Accordingly, trim face plate 70 is normally shaped similarly to and outlines pull member 51. Extension arms 58, 60 function to extend the radius between pull member 51 and axle member 54 and permit pull member 51 to rotate outward from the glove box door 5 so that it does not interfere with trim face plate 70, even if the upper edge of pull member 51 is not straight. Thus, extension arms 58, 60 permit pull member 51 to be styled in various shapes and sizes without requiring the basic latching mechanism 10 to be changed. Moreover, because extension arms 58, 60 are integrally molded with pull member 51 and axle member 54, the total number of parts in the mechanism 10 are kept to a minimum.

In the preferred embodiment, housing member 20, actuator member 40, and pivotal handle member 50 are molded from plastic, and damping bumper 68 is molded from rubber.

When assembled, handle member 50 is normally in its "closed" position such that pull member 51 is in front of and approximately parallel to the front face 19 of housing member 15. When the glove box door is in its closed position, actuator member 40 and handle member 50 are also both in their respective closed positions. Lever arm 62 abuts and exerts a force on bottom surface 46 of recess 45 opposite the bias of spring 48 to maintain actuator member 40 in its closed position and stop it from being forced out of receptacle channel 22 by spring 48. A locking bar which is fixedly attached to the glove box is trapped in crevice 39 between actuator member 40 and damping bumper 68, thereby maintaining the glove box door in the closed position. Actuator member 40 acts as a "door" to maintain the latching bar inside of crevice 39 when the glove box door is closed.

When it is desired to open the glove box door, pull member 51 is manually pulled by an operator. When pull member 51 is actuated and the applied pulling force exceeds that of the biasing of spring 48, tabs 54, 56 spin inside of mounting apertures 30, 32, permitting axle member 54 to rotate about its own longitudinal axis. As a result of extension arms 58, 60, pull member 51 is permitted to extend upward and out from the glove box door and housing member 15, and it is permitted to rotate about the longitudinal axis of axle member 54 at a greater radius than if pull member 51 had been directly connected to axle member 54. Lever arm 62 and stop arms 64, 66 also rotate with axle member 54.

When pull member 51 is actuated, lever arm 62 abuts bottom surface 46, forcing actuator member 40 against the bias of spring 48 vertically downward toward its open position. As actuator member 40 moves downward, spring 48 compresses downward over stump member 24. The downward movement of actuator member 40 is stopped when the bottom side 43 of actuator member 40 meets the closed end 21 of receptacle channel 23. Substantially simultaneously with the actuator member 40 abutting the closed end 21 of channel 23, stop arms 64, 66 abut shoulders 34, 36 to limit the rotation of handle member 50. The abutment of stop arms 64, 66 with shoulders 34, 36 reduces the chance that lever arm 62 will be damaged as a result of an excessive amount of force being applied to pull member 51 when the glove box door is opened. When actuator member 40 abuts closed end 21 and stop arms 64, 66 abut shoulders 34, 36, actuator member 40 and handle member 50 are in their respective open positions. When actuator member 40 is in its open position, the opening to crevice 39 is no longer blocked by actuator member 40, and the glove box door 5 is free to pivot away from the fixed latching bar to its open position. After the glove box door 5 is in the open position, pull member 51 is usually released by the operator, permitting actuator member 40 and handle member 50 to return to their closed positions as a result of the bias from spring 48.

When it is desired to close the glove box door, the glove box door is manually pushed toward its closed position. When the glove box door approaches its closed position, cam surface 44 of actuator member 40 makes contact with the fixed latching bar. Provided that the external pushing force is sufficient to overcome the bias of spring 48, cam surface 44 rides along the latching bar, forcing actuator member 40 downward toward its open position and compressing spring 48. As actuator member 40 moves downward, handle member 50 remains in its closed position because recess 44 is sufficiently wide to permit actuator member 40 to move into its open position without abutting lever arm 62. When actuator member 40 is depressed below the level of the latching bar, and the glove box door is pushed into its closed position, crevice 39 surrounds the fixed latching bar, and actuator member 40 snaps back to its closed position as a result of the bias force of spring 48, thus locking the glove box door 5 into place.

Preferred embodiments of the present invention have been disclosed. A person of ordinary skill in the art would realize, however, that certain modifications would come within the teachings of this invention, including, without limitation, the addition of one of several well-known locking mechanisms to the invention.

What is claimed is:

1. A door handle device, comprising:

a housing member having a receptacle channel;

an actuator member slidably disposed within said receptacle channel;

a handle member pivotally mounted to said housing member around a pivot axis;

said handle member engaging said actuator member to slide said actuator member within said receptacle channel between an open position and a closed position in response to an external actuating force applied to said handle member;

said handle member including a means for receiving an external actuating force;

said handle member further including one or more extension arms that establishes a non-linear connection path between said receiving means and said pivot axis that is capable of providing clearance between said arms and an edge of a trim face plate that extends between said receiving means and said pivot axis when said handle device is mounted with the trim face plate and is operated.

2. The door handle device of claim 1, wherein said one or more extension arms include substantially parallel reinforcing ridges that extend substantially lengthwise along said extension arms.

3. The door handle device of claim 1, wherein said one or more extension arms are integral with said axle member an said receiving means.

4. The door handle device of claim 3, wherein said actuator member includes a convex cam surface.

5. The door handle device of claim 4, further comprising a means for biasing said actuator member toward said closed position.

6. The door handle device of claim 5, wherein said biasing means is a spring.

7. The door handle device of claim 3, wherein:

said actuator member includes a recess; and said handle member includes a lever arm which engages said recess to slide said actuator member between said open position and said closed position within said receptacle channel.

8. The door handle device of claim 7, wherein said pivot axis comprises an axle member.

9. The door handle device of claim 8, wherein:

said housing member includes a first and a second mounting flange, each mounting flange having a mounting aperture; and said axle member includes a first and a second end, and each end includes a tab which engages with said corresponding mounting aperture to pivotally mount said axle member to said housing.

10. The door handle device of claim 9, wherein:

said housing member includes one or more abutment shoulders; and said axle member includes one or more stop arms that abut said corresponding abutment shoulders to limit the rotation of said handle member.

11. The door handle device of claim 10, further comprising a damping bumper disposed within said housing for abutting an external fixed locking bar.

12. The door handle device of claim 11, wherein said extension arms are defined by non-linear edges that remain approximately parallel to each other between said axle member and said receiving means.

13. The door handle device of claim 1, wherein:

said actuator member includes a recess; and said handle member includes a lever arm which engages said recess to slide said actuator member between said open position and said closed position within said receptacle channel.

14. The door handle device of claim 13, wherein said pivot point comprises an axle member.

15. The door handle device of claim 14, wherein:

said housing member includes a first and a second mounting flange, each mounting flange having a mounting aperture; and said axle member includes a first and a second end, and each end includes a tab which engages with said corresponding mounting aperture to pivotally mount said axle member to said housing.

16. The door handle device of claim 15, wherein:

said housing member includes one or more abutment shoulders; and said axle member includes one or more stop arms for abutting said corresponding abutment shoulders to limit the rotations of said handle member.

17. The door handle device of claim 16, wherein said extension arms are defined by non-linear edges that remain approximately parallel to each other between said axle member and said receiving means.

18. The door handle device of claim 1, wherein said receiving member includes an upper edge, and said pivot axis is positioned higher than said upper edge of said receiving member when said receiving member is unbiased from said external actuating force.

19. An automobile glove-box door handle and latching device, comprising:

a housing member having a receptacle channel, one or more abutment shoulders, and a first and second mounting flange with each flange having a mounting aperture;

an actuator member slidably disposed within said receptacle channel, said actuator member having a convex cam surface and a recess;

a spring disposed within said receptacle channel biasing said actuator member;

a pivotal handle member having a pull member and an axle member connected together by at least one extension arm that establishes a non-linear connection path between said receiving means and said axle member that is capable of providing clearance between said arms and an edge of a trim face plate that extends between said receiving means and said pivot axis when said handle device is mounted with the trim face plate and is operated, said axle member having first and second ends, and each end having a tab engaging with said corresponding mounting apertures;

said axle member having a lever arm engaging said actuator member recess for causing said actuator to slide within said receptacle channel; and said axle member including one or more stop arms for abutting said one or more corresponding abutment shoulders to limit the rotation of said pivotal handle member.

20. The automobile glove-box door handle device of claim 19, wherein said extension arms are defined by non-linear edges that remain approximately parallel to each other between said axle member and said receiving means.

21. The automobile glove-box door handle device of claim 20, wherein said extension arms include substantially parallel reinforcing ridges that extend substantially lengthwise along said extension arms.

* * * * *

UNITED STATES PATENT AND TRADEMARK OFFICE

CERTIFICATE OF CORRECTION

PATENT NO. : 6,152,501
DATED : November 28, 2000
INVENTOR(S) : Hugo Magi and Yuriy Tsalenko It is certified that error appears in the above-identified patent and that said Letters Patent is hereby corrected as shown below:

Column 6,
Line 31-32, replace "an said receiving means." with -- and said receiving means. --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*